US009745746B2

(12) United States Patent
Heesbeen

(10) Patent No.: US 9,745,746 B2
(45) Date of Patent: Aug. 29, 2017

(54) FALSE CEILING SUSPENSION SYSTEM, PROFILE AND METHOD

(71) Applicant: Saint-Gobain Acoustical Products International B.V., Harderwijk (NL)

(72) Inventor: Jan-Dirk Pieter Heesbeen, Hoogland (NL)

(73) Assignee: Saint-Gobain Acoustical Products International B.V., Harderwijk (NL)

( * ) Notice: Subject to any disclaimer, the term of this patent is extended or adjusted under 35 U.S.C. 154(b) by 0 days.

(21) Appl. No.: 15/026,677

(22) PCT Filed: Oct. 3, 2014

(86) PCT No.: PCT/NL2014/050682

§ 371 (c)(1),
(2) Date: Apr. 1, 2016

(87) PCT Pub. No.: WO2015/050448

PCT Pub. Date: Apr. 9, 2015

(65) Prior Publication Data

US 2016/0251855 A1 Sep. 1, 2016

(30) Foreign Application Priority Data

Oct. 4, 2013 (NL) ..... 2011556

(51) Int. Cl.
*E04B 9/06* (2006.01)
*E04B 9/16* (2006.01)
(Continued)

(52) U.S. Cl.
CPC ..... *E04B 9/067* (2013.01); *E04B 9/16* (2013.01); *E04B 9/225* (2013.01); *E04B 9/24* (2013.01); *E04B 9/30* (2013.01)

(58) Field of Classification Search
CPC ... E04B 9/06; E04B 9/127; E04B 9/18; E04B 9/24; E04B 9/067
See application file for complete search history.

(56) References Cited

U.S. PATENT DOCUMENTS 3,294,428 A * 12/1966 Lickliter ..... E04B 9/067 403/52
3,369,332 A * 2/1968 Harlan ..... E04B 9/068 52/144

(Continued)

FOREIGN PATENT DOCUMENTS

EP 0475721 A1 3/1992
JP S 51-137917 U 11/1976

(Continued)

*Primary Examiner* — Paola Agudelo
(74) *Attorney, Agent, or Firm* — Hoffmann & Baron, LLP

(57) ABSTRACT

A suspension system for a suspended ceiling includes, in an installed state, a primary profile which substantially extends in a first horizontal direction, one or more suspension elements for the suspension of the primary profile, a secondary profile which extends in a substantially second horizontal direction and which is configured to support ceiling plates, a coupling bracket for the coupling of the primary profile to the secondary profile. The coupling bracket includes a main body which couples to the primary profile; two coupling legs which extend from the main body and which connect to the secondary profile; and a positioning element which is configured to work with the primary profile to position the coupling bracket in relation to the primary profile.

13 Claims, 3 Drawing Sheets

(51) Int. Cl.

| | |
|---|---|
| ***E04B 9/22*** | (2006.01) |
| ***E04B 9/24*** | (2006.01) |
| ***E04B 9/30*** | (2006.01) |

(56) References Cited

U.S. PATENT DOCUMENTS

| | | | | | |
|---|---|---|---|---|---|
| 3,612,461 | A * | 10/1971 | Brown | E04B 9/18 | 248/317 |
| 4,040,758 | A * | 8/1977 | Sauer | E04B 9/16 | 403/188 |
| 4,479,341 | A * | 10/1984 | Schuplin | E04B 9/127 | 52/506.07 |
| 4,726,165 | A * | 2/1988 | Brinsa | E04B 9/16 | 52/506.06 |
| 6,637,710 | B2 * | 10/2003 | Yaphe | E04B 9/006 | 248/317 |
| 7,516,585 | B2 * | 4/2009 | Lehane, Jr. | E04B 9/068 | 29/897.312 |
| 8,341,913 | B2 * | 1/2013 | Meres | E04B 9/16 | 52/220.6 |

FOREIGN PATENT DOCUMENTS

| | | | |
|---|---|---|---|
| JP | S 56-171920 | U | 12/1981 |
| WO | 2008/077480 | A2 | 7/2008 |

* cited by examiner

FALSE CEILING SUSPENSION SYSTEM, PROFILE AND METHOD

CROSS-REFERENCE TO RELATED APPLICATIONS

This application is the National Stage of International Application No. PCT/NL2014/050682 filed Oct. 3, 2014, which claims the benefit of Netherlands Application No. NL 2011556, filed Oct. 4, 2013, the contents of which is incorporated by reference herein.

FIELD OF THE INVENTION

The invention relates to a suspension system for a suspended ceiling, a profile for such a system, and a method for the installation of a suspension system.

BACKGROUND OF THE INVENTION

In a known embodiment of such a suspension system, the suspension system comprises several primary profiles, several secondary profiles, several suspension elements and several coupling brackets.

The primary profiles are suspended from a structure, in particular a ceiling, using a number of suspension elements. The primary profiles are suspended parallel to each other and if necessary partly extending in line with each other in a horizontal direction. The secondary profiles are coupled to the primary profiles using coupling brackets which are configured to allow the secondary profiles to run underneath the primary profiles. The secondary profiles are fitted extending in a second substantially horizontal direction perpendicular to the first direction. The secondary profiles are configured to support ceiling plates.

The coupling brackets are installed around the primary profile with a main body, in which coupling legs extend downwards on both sides of the primary profile to attach to the secondary profile. The coupling brackets are configured for the provision of a relatively rigid connection between the primary profile and the secondary profile, wherein the primary profile and the secondary profile extend at an angle of 90 degrees to each other.

Because the secondary profiles run underneath the primary profiles, this suspension system is especially suited for concealed suspension and/or suspension of strips of ceiling plates. Here, concealed means that after the installation of the ceiling plates, the ceiling plates substantially adjoin each other in both directions. The undersides of the secondary profiles in such a concealed suspended ceiling are no longer visible or only very slightly visible. For suspension in strips, the secondary profile remains visible between the ceiling plates.

The primary profiles have openings to receive the ends of the suspension elements for the suspension of the primary profiles.

The secondary profiles have openings to receive the ends of the coupling legs of the coupling brackets. For this purpose the openings in the primary profile and the secondary profile are different in design and in different positions in relation to the relevant profile.

One disadvantage of the known suspension system is that the primary and secondary profiles are configured differently. As a consequence, during installation of a suspended ceiling, different profiles must be separated and purchased and stocked individually. The manufacturer must also produce and stock two different profiles. Different processing techniques are also required to manufacture the openings in the primary and secondary profiles.

SUMMARY OF THE INVENTION

One aim of the invention is to provide a suspension system for a suspended ceiling which enables simpler manufacture and preferably also simpler use of the profiles.

This aim is achieved using a suspension system for a suspended ceiling comprising, in an installed state:

- a primary profile which extends in a first substantially horizontal direction,
- one or more suspension elements for the suspension of the primary profile,
- a secondary profile which extends in a second substantially horizontal direction and which is configured for the support of ceiling plates,
- a coupling bracket for the coupling of the primary profile to the secondary profile, wherein the coupling bracket comprises:
  - a main body which couples to the primary profile;
  - two coupling legs which extend from the main body and couple with the secondary profile; and
  - a positioning element which is configured to cooperate with the primary profile to position the coupling bracket in relation to the primary profile, characterised in that, the primary profile and the secondary profile are each provided with a corresponding openings combination, comprising a central opening and two side openings situated on opposite sides of the central opening, wherein the central opening of the openings combination of the primary profile receives one end of the positioning element, wherein the side openings of the openings combination of the primary profile are configured to receive an end of a suspension element, and wherein the side openings of the openings combination of the secondary profile are configured to receive a leg end of a coupling leg of the coupling bracket.

By using a corresponding i.e. identical openings combination for both the primary profile and the secondary profile, the same manufacturing installation can be used to apply the openings to both the primary profile and the secondary profile. This yields considerable benefits in the manufacturing of the primary and secondary profiles.

The identical openings combination used for both primary and secondary profiles is used on one hand for attaching a suspension element and placing a positioning element in a primary profile and is used for receiving coupling legs in a secondary profile, in which the side openings are used both for receiving the suspension elements in the primary profile and receiving the coupling legs in the secondary profile.

In an embodiment, the primary profile and the secondary profile are identical profiles. By providing one single profile which can be used as a primary profile and as a secondary profile in a suspension system for a suspended ceiling, in particular for a concealed suspended ceiling or a strip-suspended ceiling, the advantage is that during manufacture and assembly, only one type of profile is required. As a result manufacture is further simplified and for assembly a single supply of profiles can be used for the installation of a suspended system with primary and secondary profiles.

In an embodiment, the distance between the side openings of the openings combination substantially corresponds to the distance of the maximum horizontal dimension of a cross section of the primary profile.

Normally, the primary and secondary profiles of a suspension system have a T-shaped cross-section which after assembly is installed upside down, i.e. after a profile has been installed, the cross section of the profile has a lower horizontal part and a vertical part which extends from about the centre of the horizontal part. There is often a tubular part on the top of the vertical part which usually has a relatively small cross-section, in order to give the profile rigidity.

In such a profile the maximum horizontal dimensions of the cross-section of the profile is determined by the dimensions of the lower horizontal part of the profile. For a rigid connection of the primary profile to the secondary profile, it is desirable that the coupling legs of the coupling bracket run on opposite sides almost abutting along both ends of the horizontal part. By allowing the side openings to substantially correspond to the dimension of the horizontal part, the correct attachment of the coupling legs in the side openings of the secondary profile can be achieved, whereby a rigid coupling between the primary profile and the secondary profile is guaranteed.

In an embodiment, the central opening is a vertical slot. A vertical slot is a suitable shape for the receipt of a positioning element of a coupling bracket.

In an embodiment, the side openings are designed in such a way that the side openings provide an aligning function when the coupling legs are placed in the side openings. By providing the side openings with an aligning function for the coupling legs, i.e. the side openings guide the secondary profile to the correct position in relation to the coupling legs, the connection of the secondary profile to the coupling bracket is facilitated.

In an embodiment, the side openings are triangular openings, in which a first edge extends in a substantially vertical direction and a second edge extends in a substantially horizontal direction, wherein the first edges of the side opening are preferably the closest edges to the central opening of the side openings.

The triangular shape of the side openings is suitable for the receipt of the ends of the suspension elements and the ends of the coupling legs. The triangular shape also forms a good guiding for the insertion of the coupling legs in both side openings.

Each other suitable design for the side openings for the receipt of the suspension element and the receipt of a coupling leg of the coupling bracket can also be used.

In an embodiment, the main body of the coupling bracket has a V-shaped cross-section, in which the point of the V has a U-shaped cross-section which complements the tubular part of the profile and in which the maximum inner width of the V-shaped cross-profile substantially corresponds to the dimensions of the horizontal part. Such embodiment provides a good fit of the primary profile in the space formed by the main body.

In a further embodiment, the U-shaped point part is provided with bulges on the inside to enhance the coupling with the tubular part.

The invention also relates to a profile for a suspension system of a suspended ceiling characterized in that the profile is suitable for use as a primary profile and as a secondary profile in the suspension system, that the profile comprises at least one openings combination with a central opening and two side openings situated on both sides of the central opening, wherein the central opening is configured, during use as a primary profile, to receive a positioning element of a coupling bracket, which coupling bracket is configured to couple a primary profile and a secondary profile to each other wherein the side openings are each configured, during use as a primary profile, to receive one end of a suspension element, which suspension element is configured to suspend a primary profile, wherein the side openings are each configured, during use as a secondary profile, to receive a leg end of a coupling leg of a coupling bracket.

The invention also relates to a profile for a suspension system of a suspended ceiling, characterized in that the profile is suitable for use as a primary profile and as a secondary profile in the suspension system, wherein the profile comprises at least one openings combination with a central opening and two side openings situated on both sides of the central opening, wherein a distance between the side openings of the openings combination substantially corresponds to the maximum horizontal dimension of a cross-section of the profile.

The profiles can be applied in a suspension system according to claims 1-13, but also in other embodiments, for example in a suspension system in which the primary profiles and secondary profiles are mounted at the same height.

The invention also provides a method for the installation of a suspension system, wherein the method comprises:

suspending the primary profile in a first direction using one or more suspension elements, wherein the end of the one or more suspension elements is placed in the side opening of the openings combination of the primary profile, arranging one or more coupling brackets on the first profile, wherein for each coupling bracket one end of the positioning element is placed in the central opening of the primary profile, and coupling the primary profile and the secondary profile using the coupling bracket, wherein the leg ends of the coupling legs of the coupling bracket are placed in the side openings of the secondary profile.

BRIEF DESCRIPTION OF THE DRAWINGS

Further features and benefits of the invention will be explained hereinafter in the description of an embodiment of the suspension system, wherein the accompanying design drawings will be referred to, in which.

DETAILED DESCRIPTION OF THE INVENTION

Figure 1:
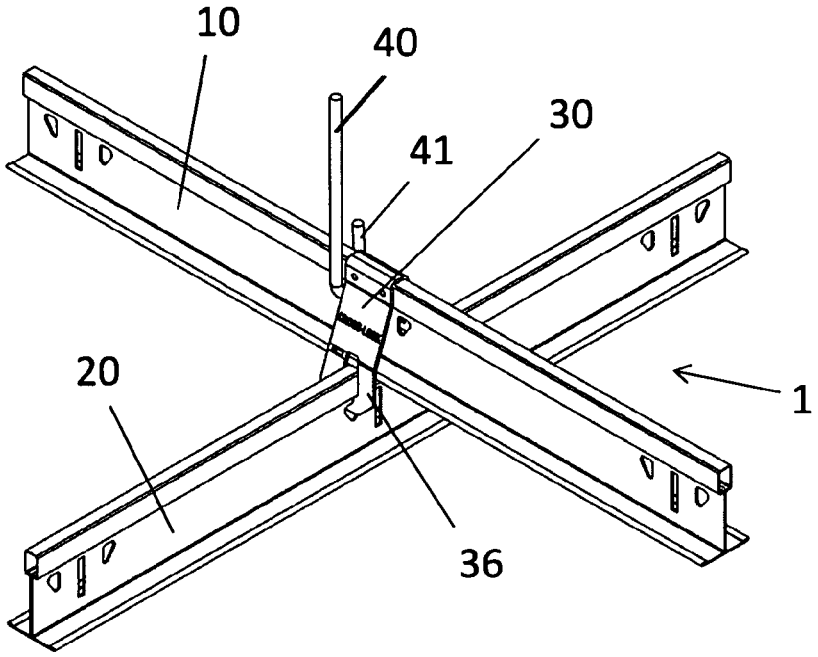
FIG. 1 illustrates a perspective view of (part of) a suspension system according to a design derived from the invention.
Figure 2:
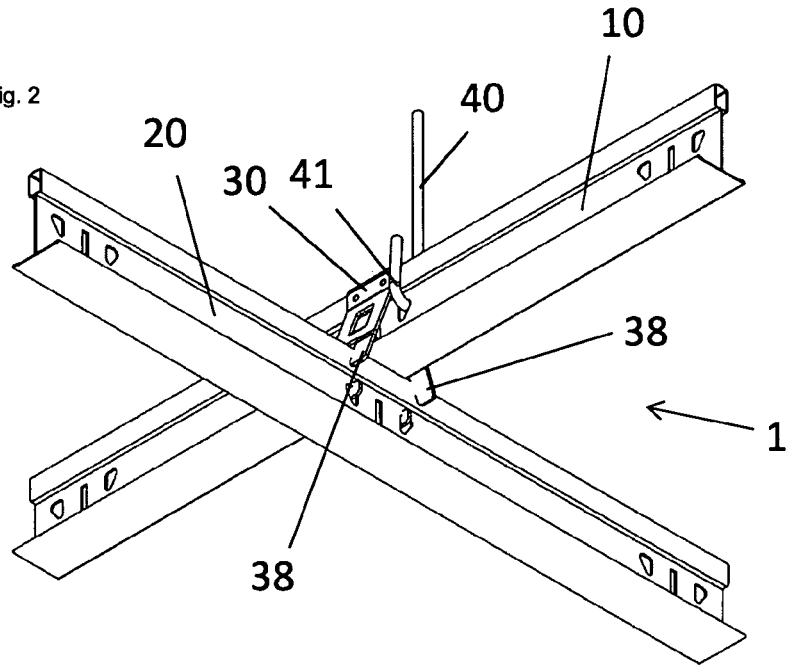
FIG. 2 illustrates a second perspective view of the suspension system in FIG. 1.

FIGS. 1 and 2 illustrate perspective views of (part of) a suspension system for a suspended ceiling generally indicated by the reference number 1.

The illustrated suspension system 1 is in particular configured to be used for a concealed suspended ceiling, in which the ceiling plates adjoin very closely so that the undersides of the profiles are invisible or only slightly visible after the installation of the ceiling plates, or for a strip ceiling system in which profiles extending in one direction are visible after the installation of the ceiling plates.

The suspension system according to the invention can also be applied for other types of ceiling systems.

Suspension system 1 comprises primary profiles 10 which extend parallel to each other in a first horizontal direction, secondary profiles 20 which run underneath the primary profiles 10 in a second horizontal direction which is substantially perpendicular to the first direction. The primary profiles 10 and secondary profiles 20 are coupled to each other by coupling brackets 30 which are configured to couple the profiles rigidly to each other at an angle of 90 degrees.

During assembly a number of primary profiles are suspended using suspension elements 40 from a structure, generally a ceiling, at a desired height. The coupling brackets 30 are then used to couple the secondary profile 20 to the primary profile 10. After the coupling of the secondary profiles 20 a grid of primary and secondary profiles is created which is suitable for bearing the ceiling plates. The ceiling plates (not illustrated) are supported by the secondary profiles 20.

The components of the suspension system are illustrated separately in FIGS. 2-6.

FIG. 2 illustrates a profile 10, 20 which can be used both as primary profile 10 and secondary profile 20. The primary profile 10 and the secondary profile 20 are therefore formed by identical profiles, as illustrated in FIGS. 1 and 2.

The profile 10, 20 has a substantially T-shaped cross-section which in the assembled state is arranged upside down; i.e. the profile 10, 20 has a horizontal part 11, configured to support ceiling plates, a vertical part 12 extending in a vertical direction from the centre of the horizontal part 11 and a tubular part 13 provided at the end of the vertical part opposite to the horizontal part 11. The tubular part 13 provides rigidity to the profile 10,20.

In the vertical part 12 an openings combination is provided with a central opening 14 and two side openings 15. The central opening 14 is designed as a vertical slot, whilst the two side openings 15 are designed as triangular openings of which a first edge 15*a* extends in a substantially vertical direction and a second edge 15*b* extends in a substantially horizontal direction. The vertically extending first edges 15*a* of the side openings 15 are the edges of the side openings 15 situated closest to the central opening 14.

The distance between the two side openings 15, in particular the distance between the two first edges 15*a*, corresponds substantially to the dimension of the horizontal part 11 of the profile 10, 20.

Figure 3:
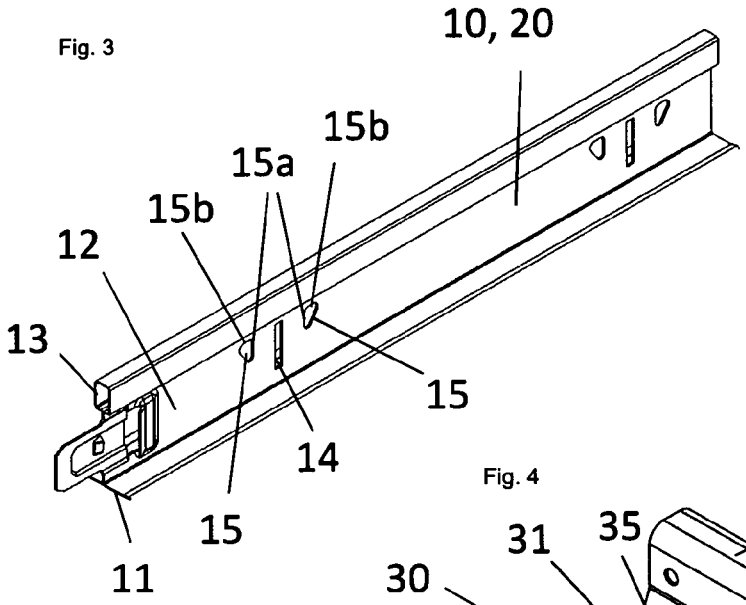
FIG. 3 illustrates a perspective view of the profile for application in the suspension system in FIG. 1.
Figure 4:
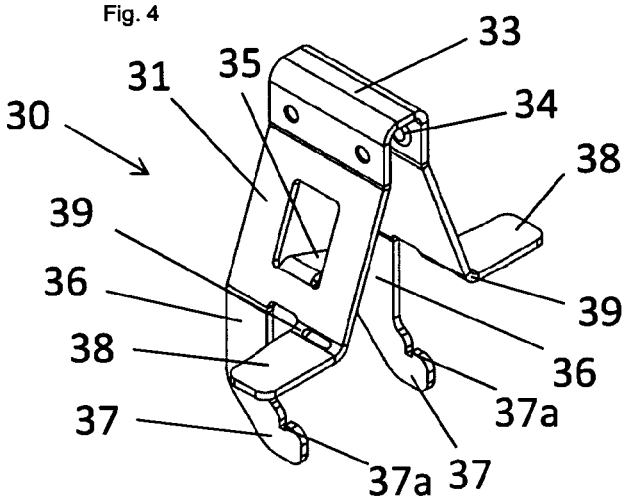
FIG. 4 illustrates a perspective view of a coupling bracket for application in the suspension system in FIG. 1.

FIGS. 3 and 4 illustrate the coupling bracket 30 for the rigid connection of a primary profile 10 and a secondary profile 20 at an angle of 90 degrees. The coupling bracket 30 comprises a main body 31 which is approximately V-shaped to create a space 32 for the receipt of a primary profile 10. The point of the V-shape has a U-shaped part 33 which is configured to fit the tubular part 13 of the primary profile 10. In the U-shaped part 33 bulges 34 are provided which extend inwardly into the U-shaped part.

As a result of these bulges 34 a strong connection is obtained when installing the coupling bracket 30 on the primary profile 10. This strength is enhanced because the bulges 34 can push in slightly the side walls of the tubular part 13, whereas they cannot push in the upper wall of the tubular part 13. As a result, the user has the feeling of a snap connection when placing the coupling bracket 30 on the primary profile 10, which facilitates its use.

Further, the main body 31 is provided with a positioning element 35 which extends into the space 32. The position and shape of the positioning element 35 is such that the coupling bracket 30 can only be placed on the primary profile 10 when the end of the positioning element 35 is placed in the central opening 14 of the primary profile 31. In this way the coupling bracket can be placed in a simple and reliable manner in the desired longitudinal position on the profile, as a result of which the correct distance between the secondary profiles 20 is guaranteed. This is relevant since this distance must correspond to the dimensions of the ceiling plates which are installed on the suspension system.

On the underside of the main body 31 two coupling legs 36 extend outward which are configured for the ends 37 of it to be connected to the side openings 15 of the secondary profile 20. For that reason, the ends 37 of the coupling legs 36 extend sideways, whereby the ends 37 of the upper side are provided with a recess 37*a* which during attachment to a secondary profile 20 cooperates with the two edges 15*b* of the respective side openings 15. During attachment both coupling legs 36 are placed on one side of the secondary profile 20.

It is noted that because the distance between the two side openings 15 substantially corresponds to the dimension of the horizontal part 11 of the primary profile 10, the horizontal part 11 is placed between the two coupling legs 36, abutting them, as a result of which the rigidity of the coupling is further enhanced.

Two flexible retaining tabs 38 which are flexible around a fold line 39 are attached to the main body 31. After the ends 37 of the coupling legs 36 are placed in the side openings 15, the secondary profile can be tilted to its installation position where the tubular part 13 of the secondary profile also abuts the coupling legs 36 and the underside of the main body 31 which is situated between the respective coupling leg 36 and the respective retaining tab 38.

By now bending the retaining taps 38 downwards around the fold line 39 so that these also extend along the tubular part 13 of the secondary profile 20 the secondary profile 20 is at least partly enclosed form-fitting in the coupling bracket 30, as illustrated in FIGS. 1 and 2. As a result a rigid connection is obtained between the primary profile 10 and the secondary profile 20.

It is remarked that any other type of locking means which is suitable for securing the secondary profile 20 at least partly in the coupling bracket 30 can also be used.

Figure 6:
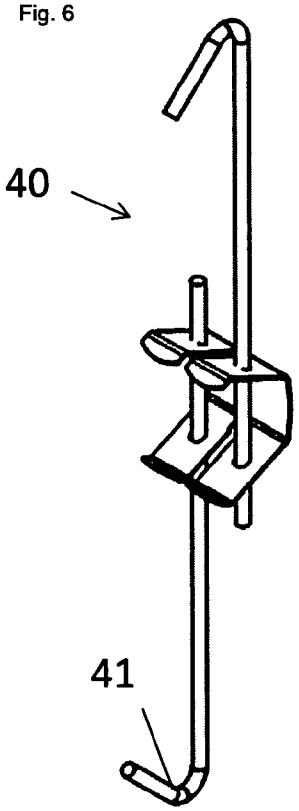
FIG. 6 illustrates a suspension element for application in the suspension system in FIG. 1.
Figure 5:
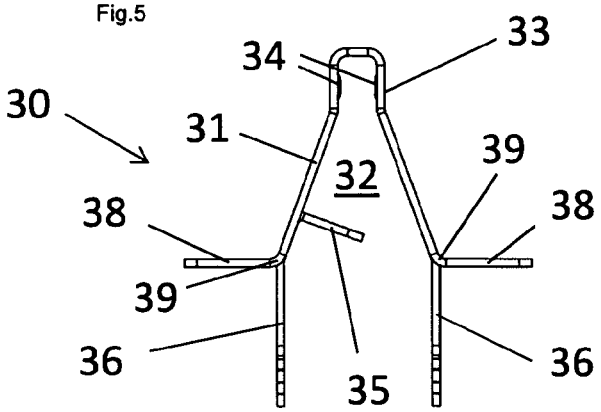
FIG. 5 illustrates a side view of the coupling bracket in FIG. 4.

FIG. 6 illustrates a suspension element 40 which is used to suspend the primary profile at a suitable height, for example to a ceiling. Such suspension elements 40 are as such known. Each of the side openings 15 is suitable for the receipt of a lower end 41 of the suspension element 40, as illustrated in FIGS. 1 and 2.

Figure 7:
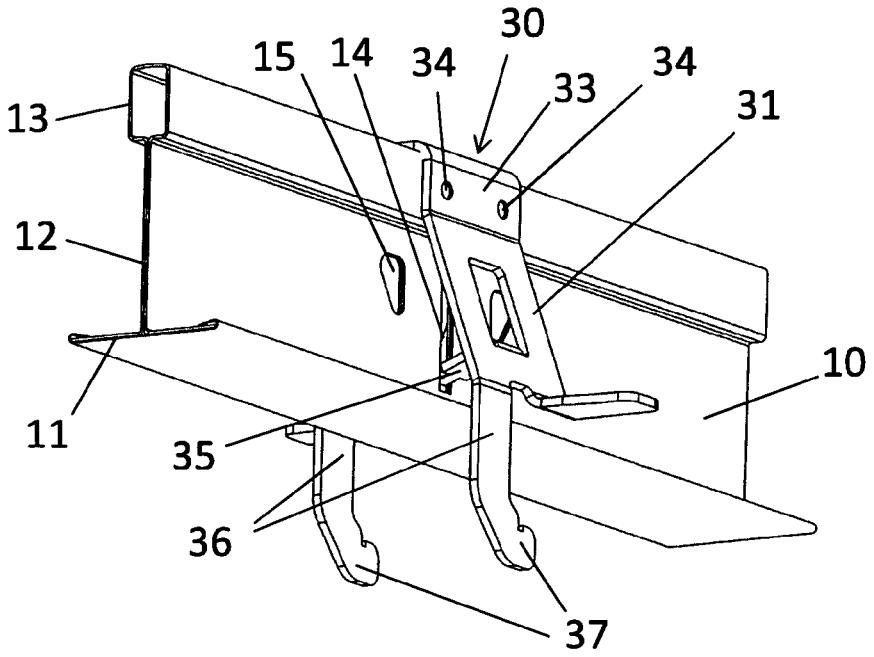
FIG. 7 illustrates a coupling bracket attached to a primary profile.

FIG. 7 illustrates a coupling bracket 30 which is attached to a primary profile for coupling to a secondary profile 20. FIG. 7 clearly shows how the end of the positioning element 35 is placed in the central opening 14, in order to achieve the correct positioning of the coupling bracket. Furthermore, the positioning of the bulges 34 is visible, as a result of which a strong coupling between the coupling bracket and the primary profile 10 is achieved. It is also clear that the coupling legs 36 substantially abut to both sides of the horizontal part 11 of the primary profile in order to increase the rigidity of the joint.

Figure 8:
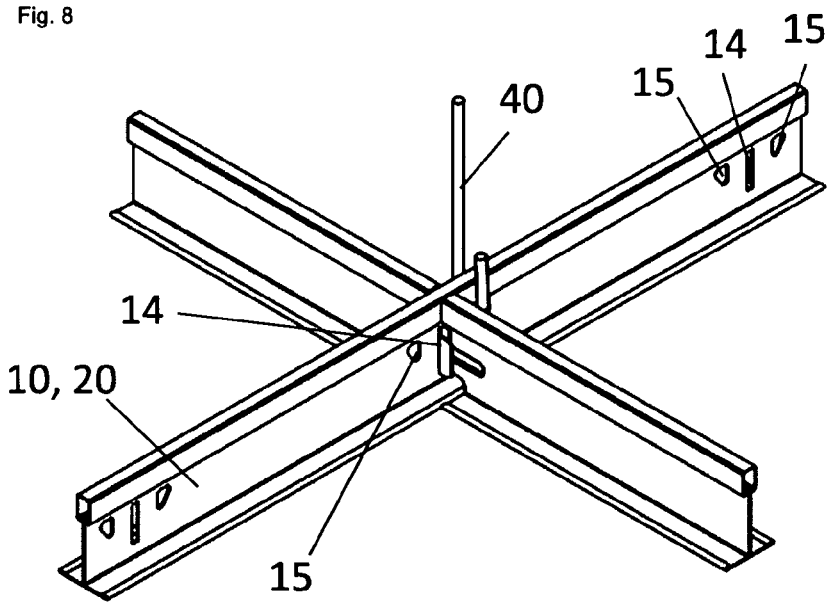
FIG. 8 illustrates a perspective view of an application for the profile according to the invention in a non-concealed suspension system.

FIG. 8 illustrates that the openings combination with central opening 14 and side openings 15 can also be used in a non-concealed suspended ceiling in which the primary profiles and secondary profiles cross at the same height. The central opening 14 can also be used as an opening through which two secondary profiles can be joined in a familiar manner, and the side openings 15 can be used for the suspension of a primary profile.

The central opening 14 can also be used in a similar manner, for example for the installation of extra cross profiles between the secondary profiles 20.

Hereinabove an embodiment of a suspension system 1 is described comprising identical primary profiles 10 and secondary profiles 20 i.e. a profile can be used both as a primary profile and a secondary profile. As a logical consequence the primary profile and the secondary profile have an identical openings combination for the receipt of a suspension element and the receipt of a positioning element and coupling legs of a coupling bracket.

In an alternative embodiment, the suspension system comprises different profiles as primary and secondary profiles, but in both profiles an identical openings combination is used for these functions.

It is remarked that where the directions "horizontal" and "vertical" are used these are applicable to the various components in the installed state. It will be evident to person skilled in the art that the various parts and components may extend in other directions in the non-installed state; in that case, the directions "horizontal" and "vertical" describe a relative relationship.

The invention claimed is:

1. A suspension system for a suspended ceiling, comprising, in an installed state:

a primary profile which extends in a first direction, one or more suspension elements for the suspension of the primary profile, a secondary profile which extends in a second direction perpendicular to the first direction and which is configured to support ceiling plates, a coupling bracket for the coupling of the primary profile and the secondary profile, wherein the coupling bracket comprises:

a main body which couples to the primary profile;

two coupling legs which extend from the main body and couple with the secondary profile; and a positioning element which is configured to cooperate with the primary profile to position the coupling bracket in relation to the primary profile, wherein the primary profile and the secondary profile are each provided with a corresponding openings combination, comprising a central opening and two side openings situated on opposite sides of the central opening, wherein the main body of the coupling bracket defines a space, in which the primary profile is placed, wherein the coupling legs extend from the main body on both sides of the space of the coupling bracket at a first side of the secondary profile, wherein the central opening of the openings combination of the primary profile receives one end of the positioning element, wherein the side openings of the openings combination of the primary profile are configured to receive one end of a suspension element, wherein the side openings of the openings combination of the secondary profile are configured to receive a leg end of one of the coupling legs of the coupling bracket, and wherein a distance between the side openings of the openings combination is similar to the maximum horizontal dimension of a cross-section of the primary profile.

2. The suspension system according to claim 1, wherein the primary profile and the secondary profile are identical profiles.

3. The suspension system according to claim 1, wherein the primary profile and the secondary profile each have a T-shaped cross section which is arranged upside down after installation.

4. The suspension system according to claim 1, wherein the primary profile and the secondary profile each have a T-shaped cross-section with a horizontal part, a vertical part which extends from the centre of the horizontal part in a vertical direction and a tubular part which is arranged at the end of the vertical part opposite to the horizontal part.

5. The suspension system according to claim 1, wherein the central opening is a vertical slot.

6. The suspension system according to claim 1, wherein the side openings are designed in such a way that the side openings provide a aligning function when placing the coupling legs in the side openings.

7. The suspension system according to claim 1, wherein the side openings are triangular openings, of which a first edge extends in a substantially vertical direction and a second edge extends in a substantially horizontal direction.

8. The suspension system according to claim 7, wherein the first edges of the side openings are the edges of the side openings which are closest to the central opening.

9. The suspension system according to claim 1, wherein the positioning element is used to position the coupling bracket longitudinally on the primary profile, and wherein the main body comprises two flexible retaining tabs which extend from the main body at both sides of the space and can be bent into a retaining position in which the retaining tabs extend to a second side situated opposite the first side of the secondary profile, so that the secondary profile is enclosed form-fitting by the primary profile, the coupling legs and the retaining tabs.

10. The suspension system according to claim 1, wherein the suspension system has several primary profiles, several secondary profiles, several suspension elements and several coupling brackets.

11. The suspension system according to claim 1, wherein the suspension system is configured for the creation of a grid for a concealed suspended ceiling or a strip suspended ceiling.

12. A method for installing a suspension system according to claim 1, wherein the method comprises:

suspending the primary profile in a first direction using the one or more suspension elements, wherein the ends of the one or more suspension elements are placed in the side openings of the openings combination of the primary profile, arranging one or more coupling brackets on the first profile, wherein for each coupling bracket one end of the positioning element is placed in the central opening of the primary profile, and coupling the primary profile and the secondary profile using the coupling bracket, wherein the leg ends of the coupling legs of the coupling bracket are placed in the side openings of the secondary profile.

13. A suspension system for a suspended ceiling, comprising, in an installed state:

a primary profile which extends in a first direction, one or more suspension elements for the suspension of the primary profile, a secondary profile which extends in a second direction perpendicular to the first direction and which is configured to support ceiling plates, a coupling bracket for the coupling of the primary profile and the secondary profile, wherein the coupling bracket comprises:

a main body which couples to the primary profile;

two coupling legs which extend from the main body and couple with the secondary profile; and a positioning element which is configured to cooperate with the primary profile to position the coupling bracket in relation to the primary profile, wherein the primary profile and the secondary profile are each provided with a corresponding openings combination, comprising a central opening and two side openings situated on opposite sides of the central opening, wherein the main body of the coupling bracket defines a space, in which the primary profile is placed, wherein the coupling legs extend from the main body on both sides of the space of the coupling bracket at a first side of the secondary profile, wherein the central opening of the openings combination of the primary profile receives one end of the positioning element, wherein the side openings of the openings combination of the primary profile are configured to receive one end of a suspension element, wherein the side openings of the openings combination of the secondary profile are configured to receive a leg end of one of the coupling legs of the coupling bracket, and wherein the main body has a V-shaped cross-section, wherein the point of the V has a U-shaped cross section which is complementary to the tubular part, and in which the maximum inner width of the V-shaped cross-section is similar to the dimension of the horizontal part.

* * * * *